US005239240A

United States Patent [19]

Omori

[11] Patent Number: 5,239,240

[45] Date of Patent: Aug. 24, 1993

[54] HALOGEN-LAMP ILLUMINATION/CONTROL CIRCUIT

[75] Inventor: Takashi Omori, Hirakata, Japan

[73] Assignee: Murata Kikai Kabushiki Kaisha, Kyoto, Japan

[21] Appl. No.: 699,765

[22] Filed: May 14, 1991

[30] Foreign Application Priority Data

May 16, 1990 [JP] Japan ..... 2-51562[U]

[51] Int. Cl.[5] ..... H05B 41/36

[52] U.S. Cl. ..... 315/291; 315/139; 315/224; 315/DIG. 7

[58] Field of Search ..... 315/291, DIG. 7, 307, 315/209 R, 224, 225, 287, 158, 159

[56] References Cited

U.S. PATENT DOCUMENTS 4,580,080 4/1986 Smith ..... 315/307 X 4,645,982 2/1987 Takayanagi ..... 315/291 X 4,745,351 5/1988 Rowen et al. ..... 315/291 X

*Primary Examiner*—Eugene R. LaRoche

*Assistant Examiner*—Do Hyun Yoo

*Attorney, Agent, or Firm*—Spensley Horn Jubas & Lubitz

[57] ABSTRACT

Disclosed herein is a halogen-lamp illumination/control circuit which includes a switching circuit unit for applying an a.c. power to the halogen lamp each time a firing pulse is received, a zero-crossing detection unit for detecting the timing at the time of zero-crossing of the a.c. power, a firing control unit for outputting a firing pulse each time a zero-crossing detection signal is received, and an illuminating command unit for supplying the firing pulse to the switching circuit unit during a period in which an illuminating command signal is inputted so as to make the same conductive.

1 Claim, 5 Drawing Sheets

HALOGEN-LAMP ILLUMINATION/CONTROL CIRCUIT

FIELD OF THE INVENTION

The present invention relates to an improvement in a halogen-lamp illumination/control circuit which is incorporated into and employed in a facsimile apparatus or the like.

DESCRIPTION OF THE RELATED ART

Heretofore, an image reading unit is constructed in such a manner that an original is irradiated with light to read image data of the original for thereby reading light reflected from the original with an image reader device. As light sources, may often be used a halogen lamp, etc.

Such a halogen lamp illuminates repeatedly each time transmission by a facsimile apparatus is made. Therefore, the halogen lamp is constructed such that a semiconductor switching device such as a thyristor is used to improve durability of the halogen lamp as an alternative to the use of a mechanical switch such as a relay.

FIG. 5 shows one example of the above-mentioned halogen-lamp illumination/control circuit. In the same drawing, there are shown a triac T100 as a switching device used to control the supply of current to a halogen lamp H100, a phototriac coupler T101 used to control the firing of the triac T100, and a resistor R100 and a capacitor C101 electrically connected in series to each other, which form a snubber circuit used to keep the firing of the triac T100 in a stable state and to absorb a surge voltage applied from the outside.

In the halogen-lamp illumination/control circuit constructed described above, the secondary side of the phototriac coupler T101 is subjected to firing for each half cycle of the a.c. power so that it is made conductive, during a period in which an illuminating command signal is inputted to the primary side of the phototriac coupler T101. As a consequence, the gate G of the triac T100 is triggered and fired, i.e., excited, thereby performing the supply of current or electricity to the halogen lamp H100.

However, according to the above-described arrangement, no conduction (firing) is made unless the a.c. voltage applied across the secondary side of the phototriac coupler T101 reaches about 30 volts to 50 volts or so as shown in FIG. 6 (*a*) and (*b*), in terms of characteristics of elements of the phototriac coupler T101. Therefore, variations in the current and voltage at the time of firing of the triac T100 are increased, thereby causing noise signals of numbers of frequency components. Meanwhile, such noise signals are harmful to the inside of an apparatus as a matter of course. However, when they are inputted to other electrical devices through a power-supply line, they are demodulated inside the radio, for example so as to produce noise, or a video signal is subjected to interference in a TV set or the like, thereby causing flicker noise. Therefore, various types of technical standards (those defined by FCC or the like, for example) are set to control the level of noise produced as interference. In order to clear the noise level defined by the technical standards described above, the noise filter circuit comprising a coil L100 and a capacitor C100 is provided in the above-described halogen-lamp illumination/control circuit as shown in FIG. 5. However, since the impedance of a power-supply circuit unit is low, the effects of the filter cannot sufficiently be obtained unless the coil L100 having a large impedance and the capacitor C100 large capacity are used. Thus, a further improvement has been desired because the shape of each device and the manufacturing cost thereof are increased, thus causing a problem that a saving of space for providing electrical components and a reduction in the manufacturing cost cannot be performed.

SUMMARY OF THE INVENTION

With the foregoing problem in view, it is a principal object of the present invention to provide a halogen-lamp illumination/control circuit which is capable of reducing the switching level of noise produced from a switching device of an a.c. power and realizing the saving of space for providing electrical components and the reduction in the manufacturing cost of the same by eliminating a noise filter circuit.

It is another object of the present invention to provide a halogen-lamp illumination/control circuit which comprises a switching circuit unit for applying an a.c. power to the halogen lamp each time a firing pulse is received, a zero-crossing detection unit for detecting the timing at the time of zero-crossing of the a.c. power, a firing control unit for outputting a firing pulse each time a zero-crossing detection signal is received, and an illuminating command unit for supplying the firing pulse to the switching circuit unit during a period in which an illuminating command signal is inputted so as to make the same conductive.

It is a further object of the present invention to provide the halogen-lamp illumination/control circuit wherein the switching circuit unit comprises at least one triac as a switching device, capacitors and a resistor, the zero-crossing detection unit comprises zener diodes, capacitors and resistors, the firing control unit comprises transistors, and resistors, and the illuminating command unit includes a photocoupler whose primary side is inputted with the illuminating command signal, a transistor, and resistors.

As switching devices used in the switching circuit unit in the above-described arrangement, may be those in which thyristors are connected in antiparallel with each other or those in which bi-directional thyristors (triacs) or the like are used.

According to the present invention, the zero-crossing detection unit outputs the zero-crossing detection signal each time the zero-crossing of the a.c. power is made, i.e., a positive half cycle is changed to a negative half cycle or vice versa. Then, the zero-crossing detection signal thus outputted is delivered to the firing control unit so as to create the firing pulse.

If no illuminating command signal is inputted to the illuminating command unit at this time, the firing pulse produced from the firing control unit is not delivered to the switching circuit unit. Therefore, the switching device is not subjected to firing and hence the halogen lamp remains unilluminated. On the other hand, when the illuminating command signal is inputted thereto, the firing pulse is delivered to the switching circuit unit for each zero-crossing of the a.c. power. In addition, the switching device is subjected to firing, thereby operably illuminating the halogen lamp. Thus, the switching device is subjected to firing at the time of the zero-crossing of the a.c. power, thereby reducing variations in the current and voltage at the time of firing and also reducing the generation of noise.

According to the present invention, the production of noise is reduced by firing, i.e., exciting the switching device at the time of zero-crossing at which variations in the current and voltage are reduced. It is therefore unnecessary to dispose a noise filter comprising a large coil and a capacitor in the power line. As a consequence, the saving of space for providing the electrical components and the reduction in manufacturing cost can be realized, and the noise produced inside the devices is also reduced, thereby making it possible to provide the halogen-lamp illumination/control circuit, which is easy to take necessary measures against the noise.

The above and other objects, features and advantages of the present invention will become apparent from the following description and the appended claims, taken in conjunction with the accompanying drawings in which a preferred embodiment of the present invention is shown by way of illustrative example.

DETAILED DESCRIPTION OF THE PREFERRED EMBODIMENTS

A preferred embodiment of the present invention will hereinafter be described with reference to the accompanying drawings.

Figure 1:
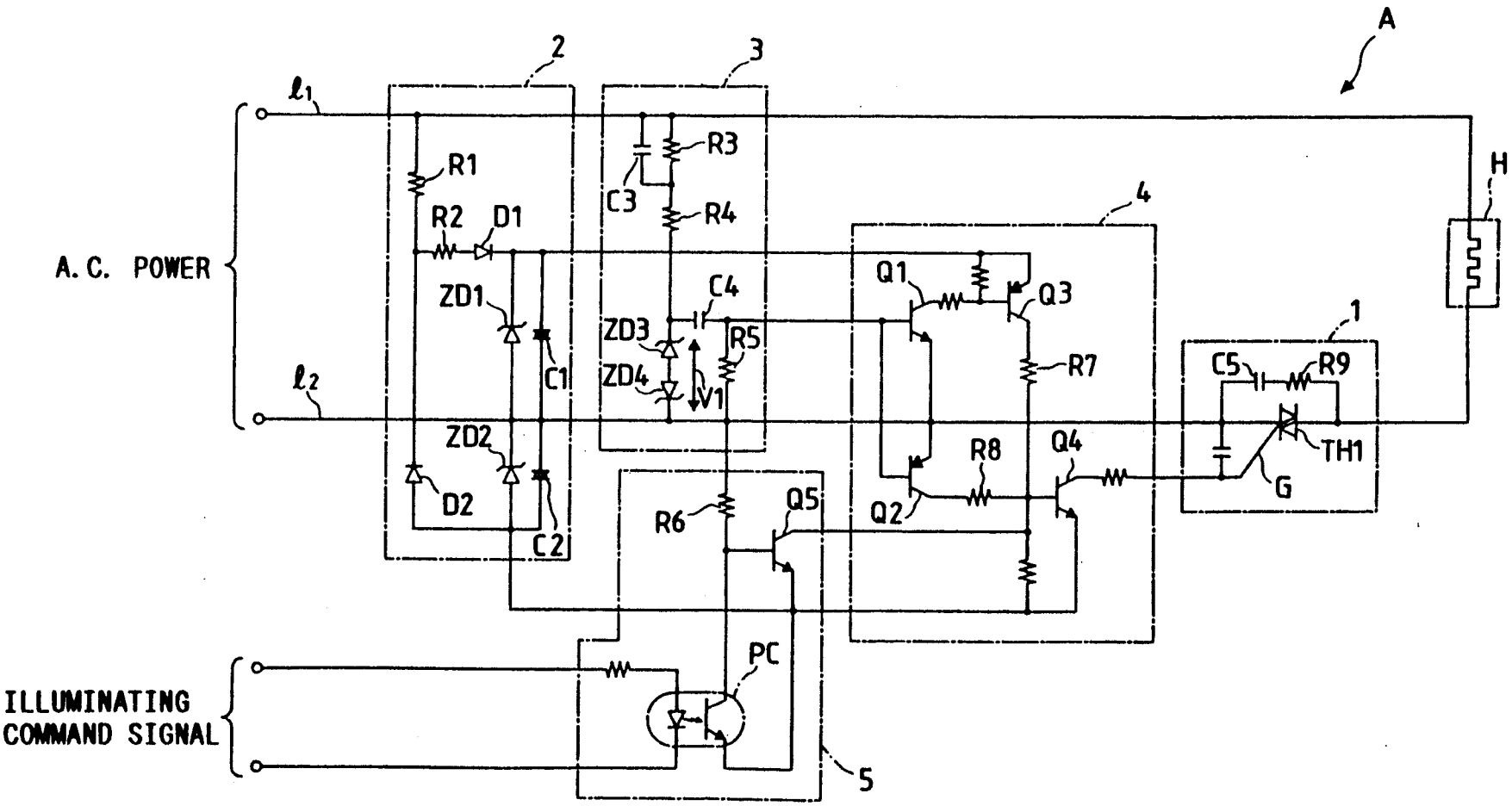
FIG. 1 is a diagram showing a halogen-lamp illumination/control circuit according to one embodiment of the present invention.

FIG. 1 is a diagram showing a halogen-lamp illumination/control circuit A according to the present embodiment of this invention. In the same drawing, there are shown a switching circuit unit 1 having a triac TH1 as a switching device for performing the control of supplying current to a halogen lamp H, a power-supply circuit unit 2 used to output d.c. positive and negative voltages in response to the supply of an a.c. power, a zero-crossing detection unit 3 for detecting the timing-upon-zero-crossing (timing at the time that a positive half cycle is changed to a negative half cycle or vice versa) so as to output a zero-crossing detection signal, a firing control unit 4 for generating a firing pulse used to perform the firing of the switching device each time a zero-crossing detection signal outputted from the zero-crossing detection circuit 3 is received, and a lighting or illuminating command unit 5 used to deliver a firing pulse generated from the firing control unit 4 to the triac TH1 of the switching circuit unit 1 during a period in which an illuminating command signal is inputted and to prohibit the transmission of the firing pulse during a period in which the illuminating command signal is not inputted. Incidentally, a resistor R9 and a capacitor C5 both connected in series to both ends of the triac TH1 in the switching circuit unit 1 serve to keep firing of the triac TH1 in a stable state, and to form a snubber circuit used to absorb a surge voltage applied from the outside.

The power-supply circuit unit 2 provides the rated voltage through resistors R1, R2, a diode D1 and a zener diode ZD1 during a period of a positive half cycle of the a.c. power for thereby supplying a voltage applied to both ends of the zener diode ZD1 to a capacitor C1, and provides the rated voltage through a zener diode ZD2, a diode D2 and the resistor R1 during a period of a negative half cycle of the a.c. power for charging a capacitor C2 with a voltage applied to both ends of the zener diode ZD2, thereby outputting positive and negative d.c. voltages with one line l2 of the a.c. power being as a reference voltage, to both ends of each of the capacitors C1 and C2.

The zero-crossing detection unit 3 provides the rated voltage through resistors R3, R4 and zener diodes ZD3, ZD4 during a period of a positive half cycle, and charges a capacitor C3 with a voltage applied to both ends of the resistor R3, thereby keeping a voltage V1 (a power line l2 being set as a reference voltage) at a point of connection of the resistor R4 and the zener diode ZD3 so as to be a predetermined level [(a zener voltage of the zener diode ZD3) +(a forward voltage of the zener diode ZD4)] over the positive half cycle as much as practicable. On the other hand, the zero-crossing detection unit 3 provides the rated voltage through the zener diodes ZD4, ZD3 and the resistors R4, R3 during a period of a negative half cycle, and charges the capacitor C3 with the voltage applied across the resistor R3, thereby keeping a voltage V1 so as to be a predetermined level [(a zener voltage of the zener diode ZD4)+(a forward voltage of the zener diode ZD3)] over the negative half cycle as much as practicable. Thus, the voltage V1 is abruptly varied from a positive predetermined value to a negative predetermined value at the time that the a.c. power is changed from the positive half cycle to the negative half cycle. Thereafter, the voltage V1 is caused to pass through a differentiating circuit comprising the resistor R5 and the capacitor C4, thereby outputting a zero-crossing detection signal in the form of a positive and negative pulse.

When a positive zero-crossing detection signal is outputted from the zero-crossing detection unit 3, the firing control circuit 4 turns on transistors Q1, Q3 so as to output a firing pulse through a resistor R7. On the other hand, when a negative zero-crossing detection signal is outputted from the zero-crossing detection unit 3, the firing control circuit 4 serves to turn on the transistor Q2 so as to output a firing pulse through a resistor R8.

In addition, when an illuminating command signal (a d.c. voltage) is applied to the primary side of a photocoupler PC, the illuminating command unit 5 causes the secondary side of the photocoupler PC to conduct so as to turn off a transistor Q5. On the other hand, when the illuminating command signal is not applied to the primary side of the photocoupler PC, the illuminating command unit 5 makes the secondary side of the photocoupler PC nonconductive so as to turn on the transistor Q5.

A description will now be made of the operation of the halogen-lamp illumination/control circuit which is constructed as describe above, with reference to the waveform shown in FIG. 2 at each part of the control circuit.

Figure 2:
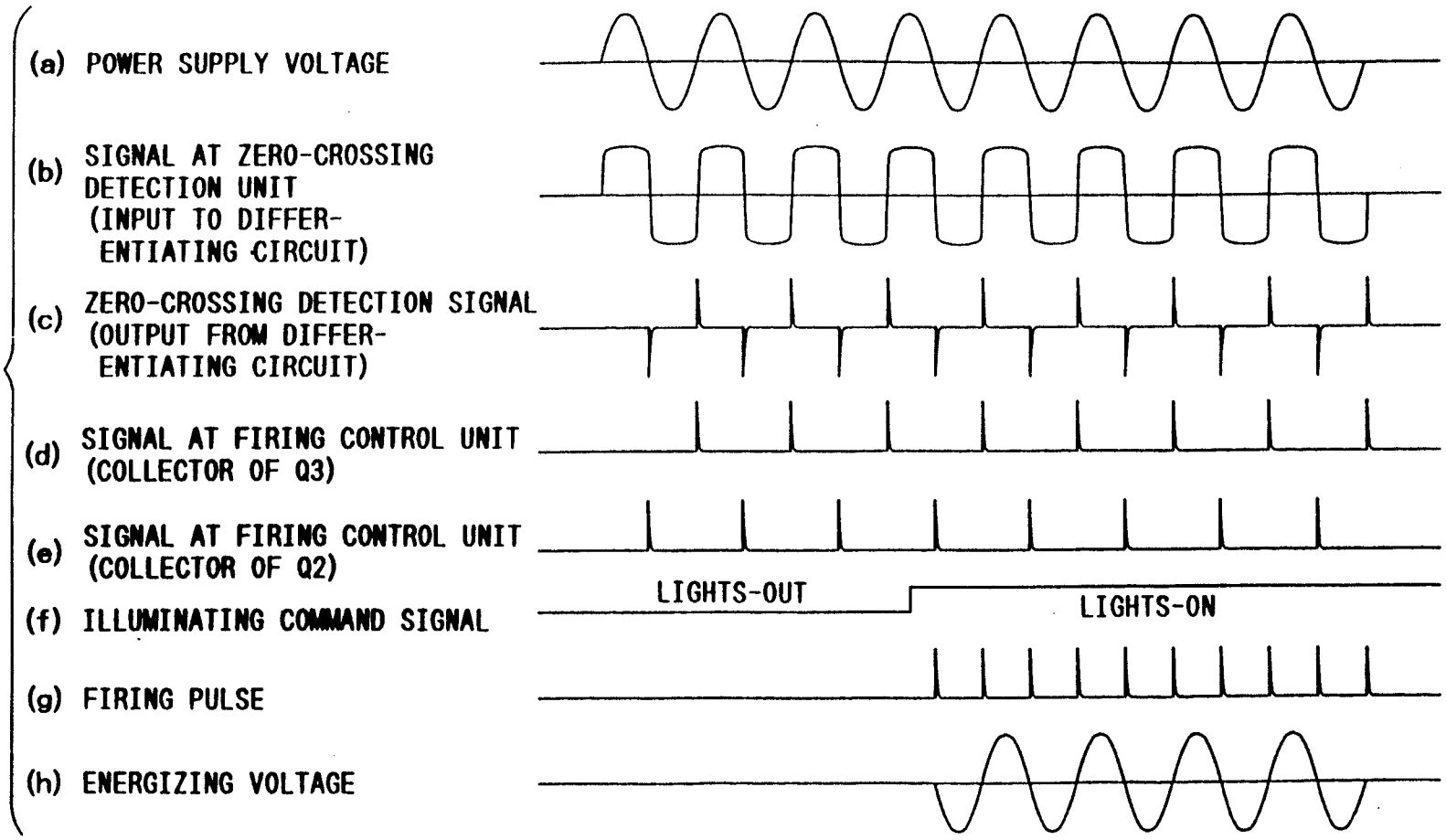
FIG. 2 (*a*) through (*h*) is waveform diagram each for describing the operation of each part of the circuit.

1. Operation at the time that the illuminating command signal is inputted to the illuminating command unit 5:

(1) When the a.c. power is changed from the positive half cycle to the negative half cycle, the zero-crossing detection unit 3 outputs a negative zero-crossing detection signal to the firing control unit 4 (see FIG. 2 (*a*) through (*c*)).

(2) The firing control unit 4 serves to turn on the transistor Q2 in response to the negative zero-crossing detection signal so as to deliver a firing pulse to the base of the transistor Q4 through the resistor R8. Since the illuminating command signal is supplied to the photocoupler PC of the illuminating command unit 5 at this time, the secondary side of the photocoupler PC is made conductive, thereby turning off the transistor Q5. Thus, the transistor Q4 delivers a firing pulse to the switching circuit unit 1 (see FIG. 2 (*e*) through (*g*)).

(3) In the switching circuit unit 1, the inputted firing pulse is inputted to a gate G of the triac TH1 so as to fire or excite the same. As a consequence, the a.c. power is supplied to the halogen lamp H (see FIG. 2 (*g*) and (*h*)).

(4) When the a.c. power is changed from the negative half cycle to the positive half cycle, the zero-crossing detection unit 3 outputs a positive zero-crossing detection signal to the firing control unit 4 (see FIG. 2 (*a*) through (*c*)).

(5) The firing control unit 4 serves to turn on the transistors Q1, Q2 in response to the positive zero-crossing detection signal so as to deliver a firing pulse to the base of the transistor Q4 through the resistor R7. Since the illuminating command signal is supplied to the photocoupler PC of the illuminating command unit 5, the secondary side of the photocoupler PC is made conductive, thereby turning off the transistor Q5. Accordingly, the transistor Q4 serves to deliver a firing pulse to the switching circuit unit 1 (see FIG. 2 (*d*), (*f*), (*g*)).

(6) In the switching circuit unit 1, the inputted firing pulse is applied to the gate G of the triac TH1 so as to fire or excite the same. Consequently, the a.c. power is supplied to the halogen lamp H (see FIG. 2 (*g*) and (*h*)).

2. When no illuminating command signal is inputted to the illuminating command unit 5, the secondary side of the photocoupler PC is not made conductive and the transistor Q5 is held on. Therefore, the transistor Q4 of the firing control unit 4 is turned off, so that a firing pulse is not delivered to the switching circuit unit 1, thus no energizing the halogen lamp H (see FIG. 2 (*f*) through (*h*)).

According to the halogen-lamp illumination/control circuit A of the present invention, as described above, the zero-crossing detection unit 3 accurately detects the timing at the time that the positive half cycle of the a.c. power is changed to the negative half cycle thereof, thereby firing the triac TH1 as the switching device. Therefore, the level of the voltage applied across the triac TH1 and the level of the current flowing therethrough at the time of firing are extremely reduced and hence the production of noise components is considerably reduced.

Figure 3:
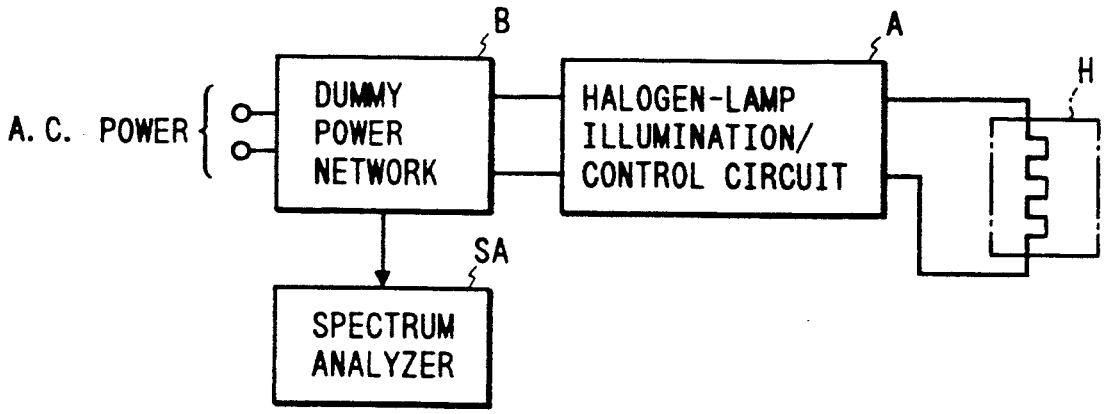
FIG. 3 is a block diagram for describing a method of measuring the level of a noise signal which leaks through a power line employed in the circuit.

FIG. 3 is a block diagram for describing a method of measuring the level of noise which leaks from the control circuit A according to the present invention to the power line. The a.c. power is supplied to the halogen-lamp illumination/control circuit A through a dummy power network B (an electrical network defined based on the technical standards). Then, a spectrum analyzer SA is electrically connected to a measuring terminal disposed in the dummy power network B so as to measure the level of noise (according to the various technical standards, the length of the a.c. power line electrically connected to the dummy power network B is also defined).

Figure 4:
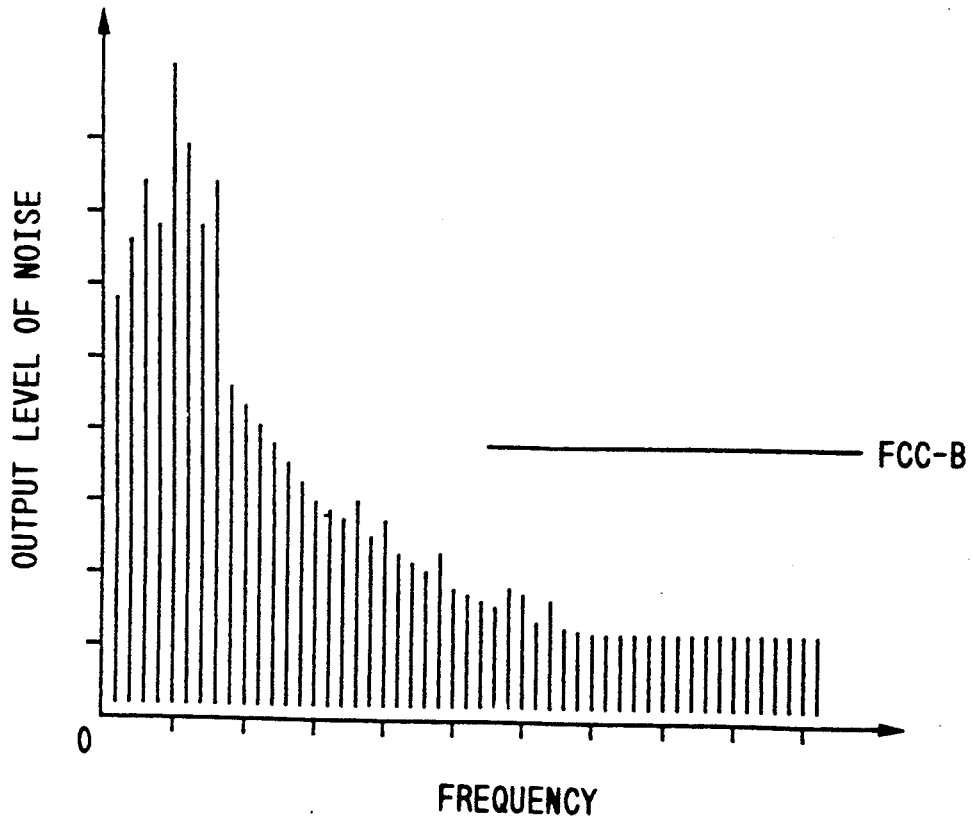
FIG. 4 is a diagram showing one example of the result of measurement of the level of the noise signal which leaks through the power line.
Figure 5:
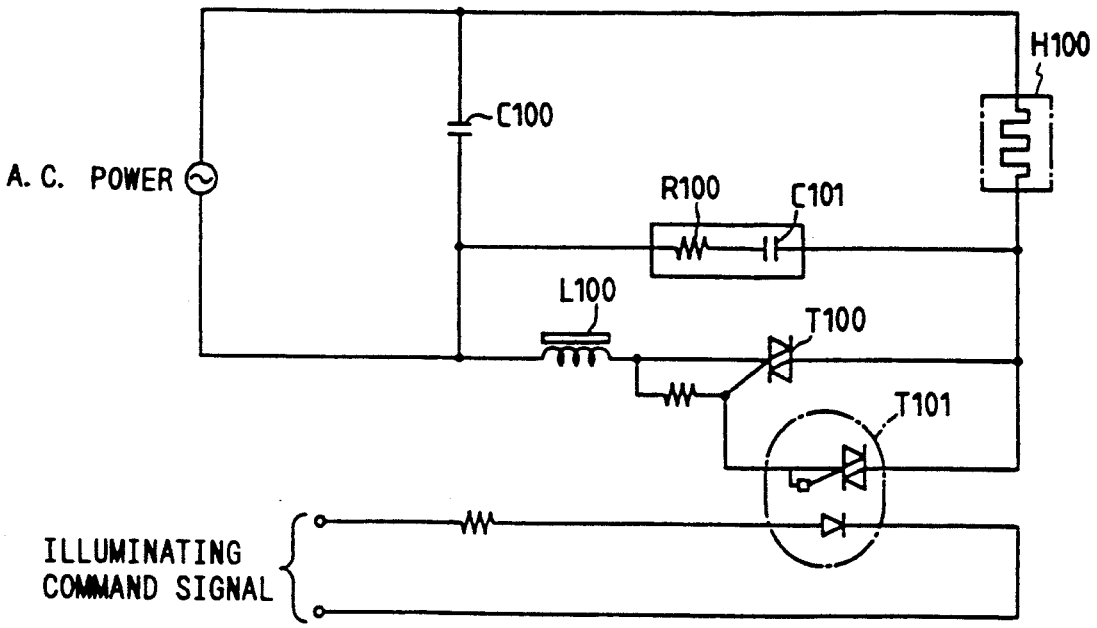
FIG. 5 PRIOR ART
FIG. 5 is a diagram showing a conventional halogen-lamp illumination/control circuit.
Figure 6:
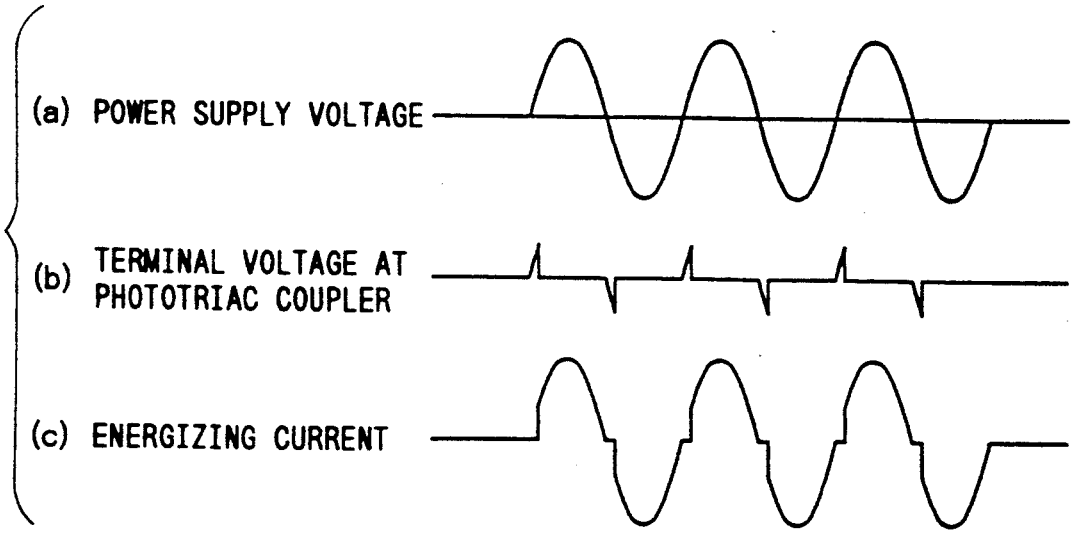
FIG. 6 PRIOR ART
FIG. 6 is a waveform diagram for describing the operation of each part of the circuit in FIG. 5.
Figure 7:
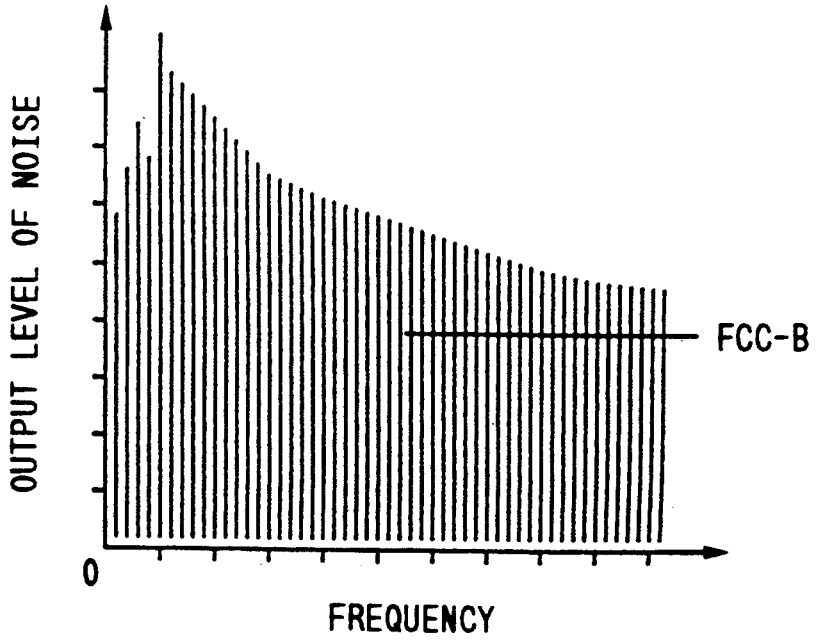
FIG. 7 PRIOR ART
FIG. 7 is a diagram illustrating one example of the result of measurement of the level of a noise signal which leaks through a power line used in the circuit of FIG. 5.

FIG. 4 shows the result obtained by measuring the level of noise which leaks through the power line of the control circuit A in the above-described manner. Thus, the noise level defined based on the technical standards by FCC or the like can easily be cleared without providing a noise filter.

Incidentally, the halogen-lamp illumination/control circuit according to the present invention can be incorporated into other apparatus as well as into a facsimile apparatus. In addition, another illuminating lamp can be used as an alternative to the halogen lamp.

Having now fully described the invention, it will be apparent to those skilled in the art that many changes and modifications can be made without departing from the spirit or scope of the invention as set forth herein.

What is claimed is:

1. An illumination/control circuit for use with a halogen lamp powered by a.c. power, the circuit comprising:

zero-crossing detection means for detecting a zero-crossing of the a.c. power and for producing a zero-crossing signal;

firing control means for outputting a firing pulse in response to the zero-crossing signal;

switching circuit means for supplying the a.c. power to the halogen lamp in response to a reception of the firing pulse; and illuminating command means for regulating transfer of the firing pulse from the firing control means to the switching circuit means, wherein the zero-crossing signal comprises positive and negative pulses, and the firing control means comprises a first transistor turned on in response to a positive pulse, a second transistor turned on in response to a negative pulse, and a third transistor which delivers the firing pulse to the switching circuit means in response to an illuminating command signal from the illuminating command means.

* * * * *